United States Patent [19]

Alphandary

[11] 4,180,186

[45] Dec. 25, 1979

[54] HOPPER

[75] Inventor: Maurice Alphandary, Oxford, England

[73] Assignee: The United States of America as represented by the Administrator of the U.S. Environmental Protection Agency, Washington, D.C.

[21] Appl. No.: 876,099

[22] Filed: Feb. 8, 1978

[51] Int. Cl.[2] ..... B65D 83/06

[52] U.S. Cl. ..... 406/152; 222/462

[58] Field of Search ..... 302/53; 214/17 R; 222/564, 460, 461, 462, 193

[56] References Cited

U.S. PATENT DOCUMENTS 3,794,386 2/1974 Hite ..... 222/564 X

*Primary Examiner*—David A. Scherbel

[57] ABSTRACT

A non-blocking hopper for solids comprising a downwardly convergent hollow frusto-conical bottom part having a maximum radius R and a discharge aperture of diameter D at the narrowest (bottom) end. At least two V-shaped notches are formed symmetrically around the bottom part with their widest ends of width b and open to the discharge aperture, their apices being remote from the periphery of the aperture at a distance r therefrom. The following relationships are observed $r \geqslant 0.3R$; $b \geqslant 0.5D$, and the angle between the axis and wall of the frustum is no greater than the angle of repose of the solids.

15 Claims, 5 Drawing Figures

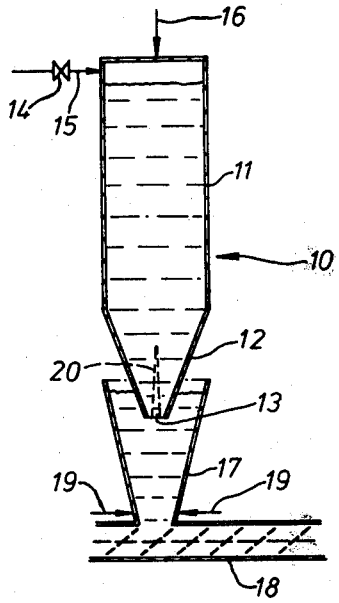
FIG. 1.
FIG. 2.
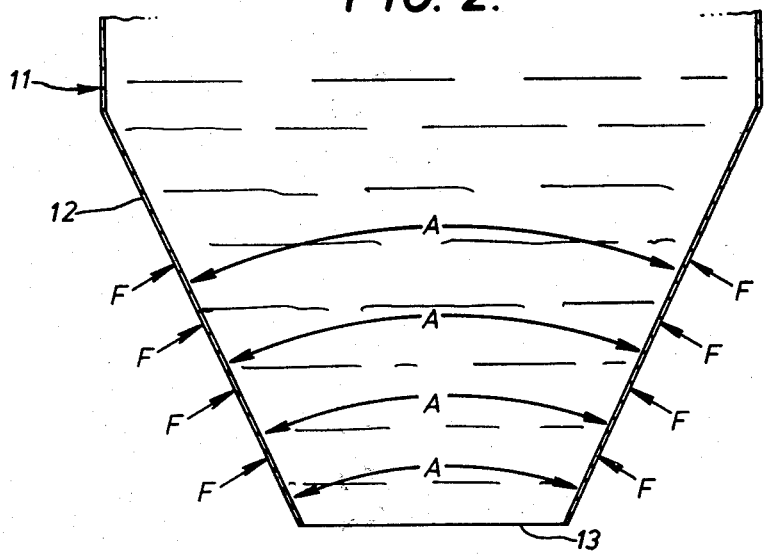

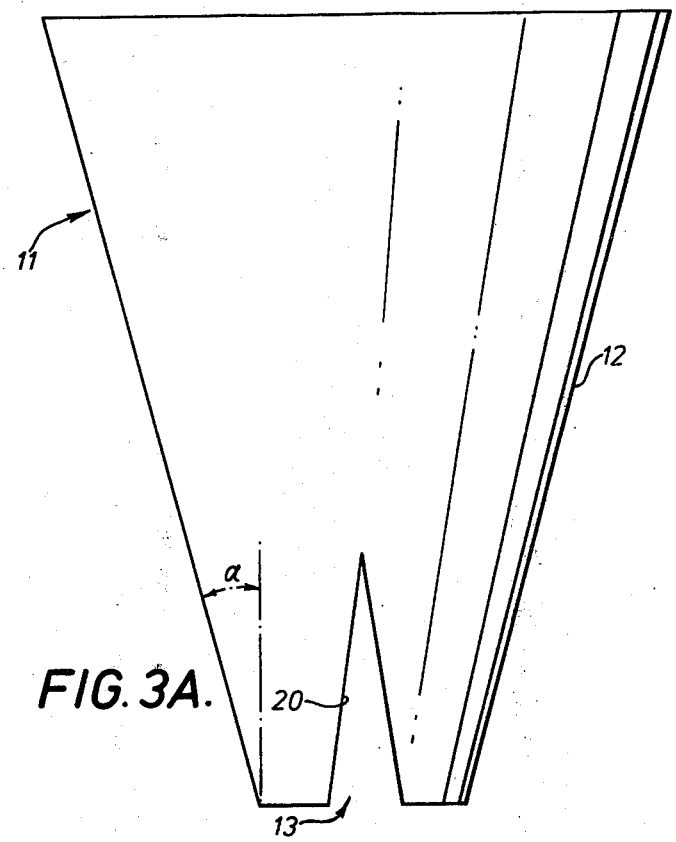
FIG. 3A.
FIG. 3B.
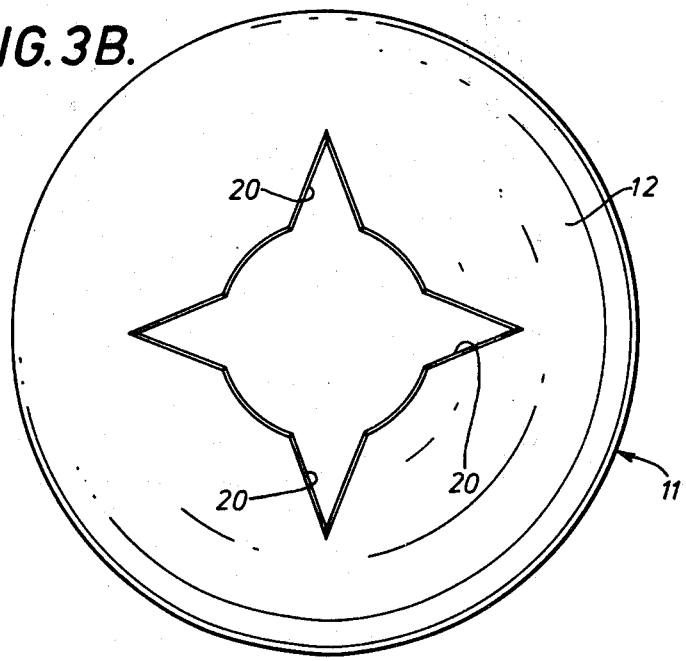

HOPPER

This invention was made under Contract No. 68-02-2159 with the U.S. Environmental Protection Agency.

The present invention relates to a hopper for feeding solids stored therein to a region beneath the hopper.

Hoppers for temporarily storing solids for subsequent supply to regions beneath the hoppers usually have a bottom portion of downwardly convergent shape with a discharge aperture at the bottom.

One of the problems encountered with hoppers of conventional designs is the packing of solids to such an extent as to cause bridging which prevents free discharge, or free discharge at a substantially uniform rate, from the discharge aperture of the hopper. Among the expedients to deal with this problem are the application of a vibrator, or mechanical or manual rapping devices. Although these expedients meet with some success, they add to the complication and cost of the hopper, and tend to be noisy. Another expedient is to employ a core-breaker which is a conical member supported from the divergent internal surface of the hopper with its apex pointing upwardly in the hopper. Core breakers are also successful in some instances, but they, too, add to the cost and complication of the hopper.

An object of the present invention is to provide a hopper for improved design which avoids, mitigates or substantially eliminates the drawbacks of previously known hoppers.

In one preferred aspect, the present invention provides a hopper of which at least the bottom part is in the form of a hollow, substantially symmetrical right-conical frustum of maximum radius R at the widest (normally upper) end with a substantially circular discharge aperture of diameter D at the narrowest (normally bottom) end, there being at least two substantially V-shaped notches formed in the wall of the frustum substantially symmetrically around the wall of the frustum the widest ends of the notches being of width b and open to the discharge aperture, and the apices of the notches being remote from the periphery of the aperture at a distance r therefrom, wherein the angle between the internal wall of the frustum and the axis thereof is no greater than the angle of repose of the solids to be contained therein, r is at least equal to 0.3R and b is at least equal to 0.5D.

Although r can have values exceeding 0.5R, these higher values are generally impracticable and therefore, in general, less preferred.

The problem of blocking of hoppers has heretofore been relatively common, particularly with finer solids (e.g. 3000 microns or less) and/or when the solids are compressible (e.g., coal, flour, sugar, sawdust, etc.). The hopper of the present invention enables such solids, and others which may not necessarily be subject to blocking problems, to be temporarily stored in, and supplied from hoppers with substantially no problem. With larger particles, the scale of the hopper must be increased.

The invention is now further described with reference to some non-limitative embodiments thereof, and with reference to the accompanying drawings, in which:

FIG. 1 is a diagrammatic vertical cross-section of an installation for supplying a particulate solid such as coal;

FIG. 2 shows part of the installation of FIG. 1 and force vectors therein;

FIG. 3 illustrates, in FIG. 3A, a side view of a hopper according to the invention, and in 3B an underneath plan view of same.

Figure 4:
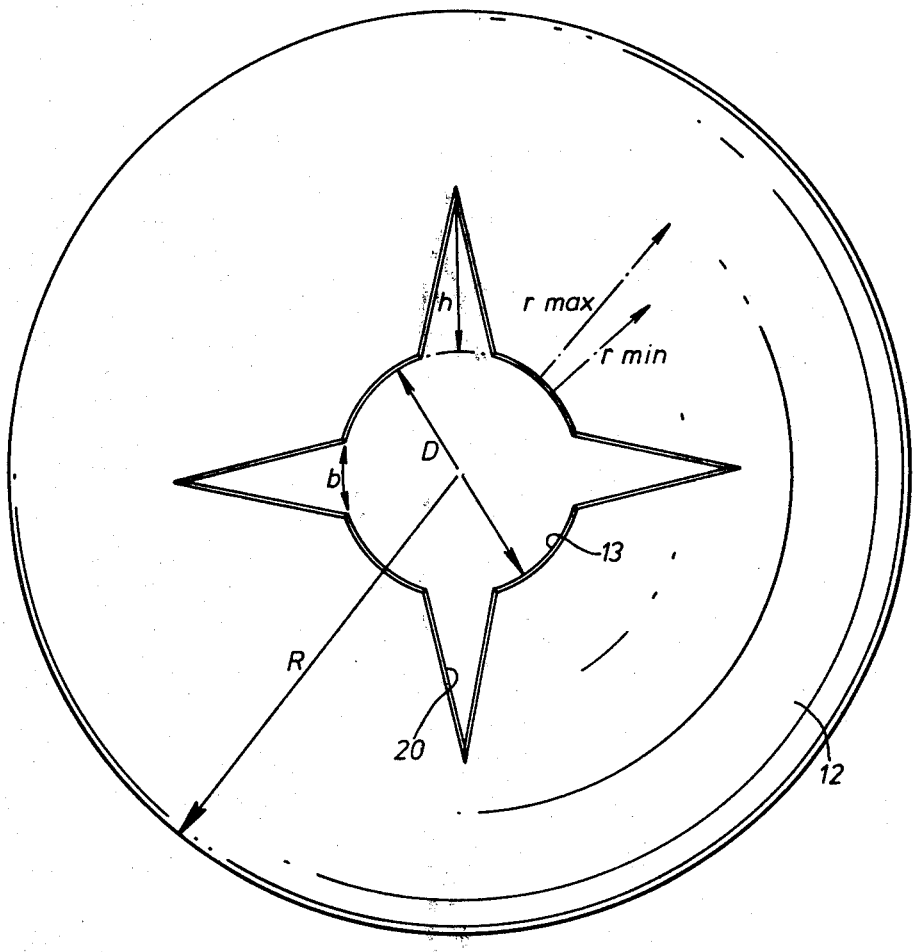
FIG. 4 shows some of the mathematical parameters which are employed in deriving the dimensions of a hopper in accordance with the invention.

The installation 10 of FIG. 1 comprises a hopper having a frusto-conical bottom 12 with an aperture 13 at its base. The top of the hopper is pressurized by, e.g., nitrogen supplied via valve 14 and line 15 to avoid the information of potentially ignitable mixtures of air and particulate solids. Solids are supplied to the top of the hopper via a suitable feeding device (not shown) and conduit 16. A reservoir vessel 17 of generally upwardly-diverging shape is disposed beneath the hopper 11 for receiving solids from the aperture 13 thereof. As depicted, the reservoir vessel 17 tends to fill until the aperture 13 is at least at the top level of solids therein. The reservoir vessel 17 is open at its base to a screw feed 18. During operation, air is passed into the vessel 17 just above its base via a number of jets 19 to promote fluidization of the solids therein and thereby facilitate the passage of solids from the reservoir vessel into the screw feed 18. When thus fluidized, the solids in reservoir vessel 17 form an expanded bed having a top surface above the level of the aperture 13, as shown, the fluidizing air escaping via the annular gap between the inner wall of vessel 17 and the outer wall of the hopper 11. As solids pass from the reservoir vessel 17 to the screw feed 18, solids should automatically flow from the hopper 11 to replenish the loss from vessel 17. However, when the hopper 11 is not a hopper in accordance with the invention, this replenishment may fail to take place due to packing of the solids in the frustal part (the frusto-conical bottom 12) of the hopper 11. It is believed that the packing in part 13 is due to the build-up of lateral forces F as indicated generally in FIG. 2, the zone in which bridging is most likely to occur being indicated by A.

FIG. 3 illustrates, generally, the manner in which any propensity to bridging may be diminished or eliminated. As will be seen from FIG. 3A, the frusto-conical part 12 of the hopper 11 is formed with a number of downwardly diverging notches 20 having their widest part at the base communicating with the aperture 13. The apices of the notches are, as a rule, in the frusto-conical part 12 below the top thereof. There may be at least two notches 20, and they must be disposed substantially equiangularly around the frusto-conical part 12. The actual number of notches depends on the relative dimensions of the solid particles and the aperture 13, their compressibility and the angle of convergence of the frusto-conical part 12 and the weight of solids in the hopper 11. The number of notches 20 is shown to be four in FIG. 3B. In an actual situation, it will be within the capabilities of the skilled technologist to determine, by simple experiments, how many notches are required for a particular duty.

The angle alpha (FIG. 3A) between the wall and the axis of the frusto-conical part 12 (i.e. half the angle included by diametrically opposed portions of the wall thereof) must be no greater, and is preferably smaller, than the angle of repose of the solids to be supplied from the hopper 11. The skilled technologist will know or be able to determine what an appropriate angle will be for particular solids.

With reference to FIG. 4, it has been found that certain geometrical criteria must be observed to avoid bridging. In FIG. 4, R is the radius at the top of the frusto-conical portion 12, D is the diameter of the aperture 13, h is the height of each notch 20 and b is the width of each notch where it joins aperture 13. The criteria to be observed are as follows:

| | | | |
|---|---|---|---|
| | b | ≧ | 0.5D |
| | h | ≧ | 0.3R |
| and, preferably | h | ≦ | 0.5R |

As shown, by way of illustration in FIG. 4, h should preferably be between the limits $r_{min}$ and $r_{max}$ wherein $r_{min}=0.3R$ and $r_{max}=0.5R$.

It is to be understood that the invention as above described is not restricted to the illustrated embodiments, and may be employed with hoppers which are not pressurized and/or which do not discharge into reservoir vessels.

It will be appreciated that the drawings are not to scale.

What we claim is:

1. A hopper for use in feeding solids stored therein to a region beneath the hopper in which at least the bottom part is in the form of a hollow, substantially symmetrically right-conical frustum of maximum radius R at the widest (normally upper) end with a substantially circular discharge aperture of diameter D at the narrowest (normally bottom) end, there being at least two substantially V-shaped notches formed in the wall of the frustum substantially symmetrically around the wall of the frustum, the widest ends of the notches being of width b and open to the discharge aperture, and the apices of the notches being remote from the periphery of the aperture at a distance r therefrom, wherein the angle between the wall of the frustum and the axis thereof is no greater than the angle of repose of the solids to be contained in the hopper, r is at least equal to 0.3R and b is at least equal to 0.5D.

2. A hopper according to claim 1 in which r is no greater than 0.5R.

3. A hopper according to claim 1 or claim 2 comprising a substantially hollow cylindrical part attached to, and extending upwardly from, the top of the frustum.

4. A hopper according to claim 3 in which the top is closed and adapted to receive solids through the top or through the side at a location near the top.

5. A hopper according to claim 2 comprising a substantially hollow cylindrical part attached to, and extending upwardly from, the top of the frustum, said top of the hopper being closed and the hopper being adapted to receive solids through the top or through the side at a location near the top.

6. A hopper according to claim 1 or claim 2 in which the top is closed and adapted to receive solids through the top or through the side at a location near the top.

7. A hopper according to claim 6 provided with means for connecting the interior thereof to a source of a pressurizing fluid.

8. The combination comprising a hopper according to claim 1 or claim 2 with a downwardly convergent reservoir for receiving solids from the discharge aperture of the hopper, and conveying means for conveying solids from the bottom of the said reservoir towards a location where the solids are to be used.

9. The combination of claim 8 comprising means for passing a fluidizing fluid into the reservoir adjacent to the base thereof for promoting the fluidization of any solids therein.

10. A hopper according to claim 1 comprising a substantially hollow cylindrical part attached to, and extending upwardly from, the top of the frustum, said top of the hopper being closed and the hopper being adapted to receive solids through the top or through the side at a location near the top.

11. A hopper according to claim 10 provided with means for connecting the interior thereof to a source of pressurizing fluid.

12. A hopper according to claim 1 or claim 2 provided with means for connecting the interior thereof to a source of a pressurizing fluid.

13. The combination comprising a hopper according to claim 1 or claim 2 with a downwardly convergent reservoir for receiving solids from the discharge aperture of the hopper, and conveying means for conveying solids from the bottom of the said reservoir towards a location where the solids are to be used, and means for passing a fluidizing fluid into the reservoir adjacent to the base thereof for promoting the fluidizing of any solids therein.

14. The combination comprising a hopper according to claim 1 or claim 2 with a downwardly convergent, open topped reservoir for receiving solids from the discharge aperture of the hopper, and conveying means for conveying solids from the bottom of the said reservoir towards a location where the solids are to be used and means for passing a fluidizing fluid into the reservoir adjacent to the base thereof for promoting the fluidization of any solids therein.

15. The combination comprising a hopper according to claim 1 or or claim 2 with a downwardly convergent, open topped reservoir for receiving solids from the discharge aperture of the hopper, and a screw feed conveyor for conveying solids from the bottom of the said reservoir towards a location where the solids are to be used, and means for passing a fluidizing fluid into the reservoir adjacent to the base thereof for promoting the fluidization of any solids therein.

* * * * *